US007147315B2

(12) United States Patent
Keenan et al.

(10) Patent No.: US 7,147,315 B2
(45) Date of Patent: Dec. 12, 2006

(54) INKJET PRINTHEADS

(75) Inventors: Phil Keenan, Lucan (IE); Mark Loughlin, Dublin (IE); Edward Savage, Corvallis, OR (US); Kevin Dooley, Wicklow (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 302 days.

(21) Appl. No.: 10/832,413

(22) Filed: Apr. 27, 2004

(65) Prior Publication Data

US 2004/0263595 A1 Dec. 30, 2004

(30) Foreign Application Priority Data

Apr. 30, 2003 (EP) ..... 03101195

(51) Int. Cl.
*B41J 2/19* (2006.01)

(52) U.S. Cl. ..... 347/93

(58) Field of Classification Search ..... 347/63, 347/65, 87, 92, 93; 29/890.01
See application file for complete search history.

(56) References Cited

U.S. PATENT DOCUMENTS 5,141,596 A 8/1992 Hawkins et al.
5,204,690 A 4/1993 Lorenze et al.
5,716,533 A * 2/1998 O'Neill et al. ..... 216/27
6,199,980 B1 3/2001 Fisher et al.
6,260,957 B1 * 7/2001 Corley et al. ..... 347/63
6,364,466 B1 4/2002 Chen et al.
6,916,090 B1 * 7/2005 Valley et al. ..... 347/93
6,951,383 B1 * 10/2005 Giere et al. ..... 347/56
2002/0149650 A1 10/2002 Cruz-uribe et al.

FOREIGN PATENT DOCUMENTS

EP 0 675 000 10/1995
EP 0 924 078 6/1999
EP 1 297 959 4/2003

* cited by examiner

*Primary Examiner*—Anh T. N. Vo

(57) ABSTRACT

An inkjet printhead having a substrate and having at least one ink supply slot extending through the thickness thereof and providing fluid communication between an ink supply and a plurality of ink ejection elements, wherein the ink supply slot is filled to at least part of its depth with a selectively exposed and developed resist material having a plurality of ink feed holes therethrough forming a filter.

14 Claims, 7 Drawing Sheets

INKJET PRINTHEADS

TECHNICAL FIELD

This invention relates to inkjet printheads and to methods of fabricating such printheads.

BACKGROUND ART

Inkjet printers operate by ejecting small droplets of ink from individual orifices in an array of such orifices provided on a nozzle plate of a printhead. The printhead forms part of a print cartridge which can be moved relative to a sheet of paper and the timed ejection of droplets from particular orifices as the printhead and paper are relatively moved enables characters, images and other graphical material to be printed on the paper.

A typical conventional printhead is fabricated from a silicon substrate having thin film resistors and associated circuitry deposited on a front surface of the substrate. The resistors are arranged in an array relative to one or more ink supply slots in the substrate, and a barrier material is formed on the substrate around the resistors to isolate each resistor inside a thermal ejection chamber. The barrier material is shaped both to form the thermal ejection chambers, and to provide fluid communication between the chambers and the ink supply slot. In this way, the thermal ejection chambers are filled by capillary action with ink from the ink supply slot, which itself is supplied with ink from an ink reservoir in the print cartridge of which the printhead forms part.

The composite assembly described above is typically capped by a metallic nozzle plate having an array of drilled orifices which correspond to and overlie the ejection chambers. The printhead is thus sealed by the nozzle plate, with the only path for ink flow from the print cartridge being via the orifices in the nozzle plate.

The printhead operates under the control of printer control circuitry which is configured to energise individual resistors according to the desired pattern to be printed. When a resistor is energised it quickly heats up and superheats a small amount of the adjacent ink in the thermal ejection chamber. The superheated volume of ink expands due to explosive evaporation and this causes a droplet of ink above the expanding superheated ink to be ejected from the chamber via the associated orifice in the nozzle plate.

Many variations on this basic construction will be well known to the skilled person. For example, a number of arrays of orifices and chambers may be provided on a given printhead, each array being in communication with a different coloured ink reservoir. The configurations of the ink supply slots, printed circuitry, barrier material and nozzle plate are open to many variations, as are the materials from which they are made and the manner of their manufacture.

Because of their very small dimensions, printheads of this general type have the disadvantage that the ink passageways of the structure are liable to blockage by ink particles or other contaminants. One way to avoid this is to provide alternative ink supply paths that bypass the main ink supply slot and provide alternate paths for ink—see, for example, our U.S. Pat. No. 6,364,466. FIG. 7 of that patent shows shallow ink bypass channels which extend laterally away from the main ink supply slot and allow ink to reach the ink ejection chambers even though the main ink supply slot is blocked.

However, such solutions tend to involve complex structures which lead to additional undesirable processing steps. They also provide small features which can trap bubbles of air entrained in the ink.

It is an object of the invention to provide a new construction of inkjet printhead in which these disadvantages are avoided or mitigated.

DISCLOSURE OF THE INVENTION

The invention provides an inkjet printhead comprising a substrate having at least one ink supply slot extending through the thickness thereof and providing fluid communication between an ink supply and a plurality of ink ejection elements, wherein the ink supply slot is filled to at least part of its depth with a selectively exposed and developed resist material having a plurality of ink feed holes therethrough forming a filter.

The invention further provides a method of making an inkjet printhead comprising providing a substrate having at least one ink supply slot extending through the thickness thereof to provide fluid communication between an ink supply and a plurality of ink ejection elements, filling the ink supply slot to at least part of its depth with a resist material, and selectively exposing and developing the resist material to provide a plurality of ink feed holes therethrough forming a filter.

The invention further provides a print cartridge comprising a cartridge body having at least one aperture for supplying ink from at least one ink reservoir to a printhead, and a printhead as specified above mounted on the cartridge body with said at least one aperture in fluid communication with said at least one ink supply slot in the printhead.

In the present specification, by a resist material we mean a material which can be selectively exposed to radiation and subsequently chemically developed to dissolve away the unexposed (in the case of a positive resist) or exposed (in the case of a negative resist) material. For example, the resist material may be a photoresist or an ion-imageable resist. Such resist materials are of course well known in the art.

As used herein, the terms "inkjet", "ink supply slot" and related terms are not to be construed as limiting the invention to devices in which the liquid to be ejected is an ink. The terminology is shorthand for this general technology for printing liquids on surfaces by thermal, piezo or other ejection from a printhead, and while the primary intended application is the printing of ink, the invention will also be applicable to printheads which deposit other liquids in like manner.

Furthermore, the method steps as set out herein need not necessarily be carried out in the order set out, unless implied by necessity. Thus, for example, it is equally possible that the thin film resistors or other ink ejection elements could be deposited after the ink supply slot has been created in the substrate. As a further example, it is not necessary that the selectively exposed resist in the ink supply slot be developed before overlying structure is set down, since at last part of that structure could be produced by selective exposure of a photoresist which could be developed at the same time as the resist in the ink supply slot.

BRIEF DESCRIPTION OF THE DRAWINGS

FIG. 1 shows a portion 10 of a silicon wafer for use as a substrate in an inkjet printhead according to a preferred embodiment of the invention. The substrate 10 has opposed substantially parallel front and rear surfaces 14 and 15 (the rear surface 15 is not seen in FIG. 1 but can be seen in FIG. 2) and three ink supply slots 12 cut fully through the substrate 10 from the front surface 14 to the rear surface 15. In a fully assembled print cartridge, each of these slots 12 will communicate with a passage leading to a reservoir containing a different coloured ink.

Figure 2:
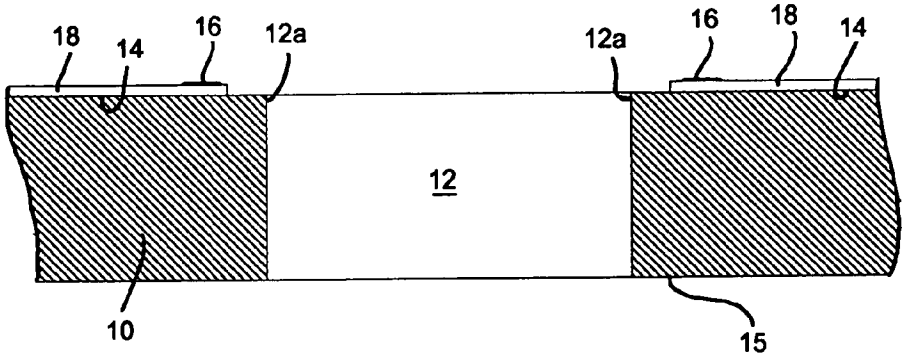
FIG. 2 is a partial enlarged sectional elevation through the substrate of FIG. 1, taken along the line II—II.

Located on the front surface 14 of the substrate 10, alongside the edge 12*a*, FIG. 2, of each slot 12 is an array of thin film heating resistors 16 which are connected via conductive traces 18 to a series of contacts 20. Contacts 20 are used to connect the traces 18 via flex beams (not shown), with corresponding traces on a flexible printhead-carrying circuit member (not shown), which in turn is mounted on a print cartridge. The flexible printhead-carrying circuit member enables printer control circuitry located within the printer to selectively energise individual resistors under the control of software in known manner. As discussed, when a resistor 16 is energised it quickly heats up and superheats a small amount of the adjacent ink which expands due to explosive evaporation.

Figure 1:
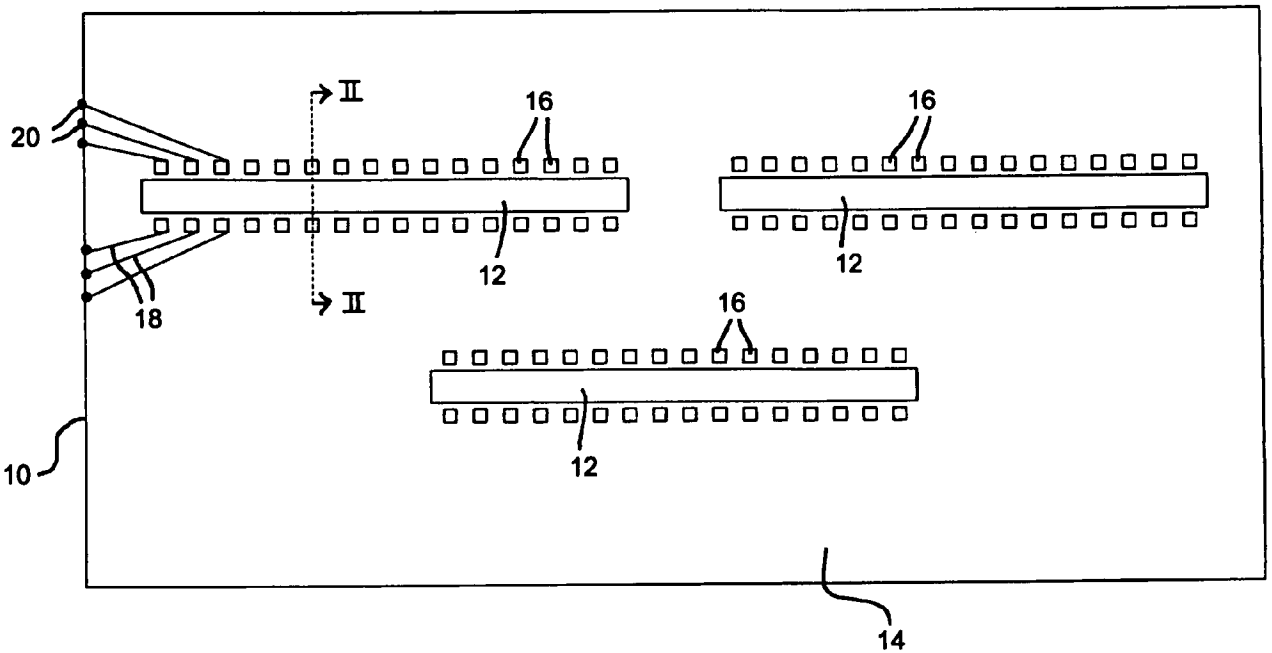
FIG. 1 is a plan view of a silicon substrate for use in a printhead according to a preferred embodiment of the invention having resistors and associated circuitry deposited thereon.

Only a few traces 18 are shown in FIG. 1. In the present embodiment, it will be understood that each resistor 16 will be provided with a trace leading to a contact 20, and generally also with a trace providing connection to a common earth. Such details are part of the state of the art and are familiar to the skilled person.

FIG. 2 shows a cross-section of the substrate 10 in the vicinity of an ink supply slot 12 (the sizes of the various components are not to scale). It can be seen that adjacent the periphery 12*a* of the ink supply slot 12 on the front surface 14 of the substrate 10, is provided a resistor 16 connected to a conductive trace 18. Again, for simplicity, the details of the deposited thin film layers 16,18 have been omitted for simplicity. In a typical embodiment, the thin film layers will include not just the resistors (which may be formed from e.g. TaAl) and the conductive traces (e.g. Au, Al or Cu) leading from the power supply to the resistor and from the resistor to earth, but also various layers providing thermal insulation (e.g. $SiO_2$), chemical protection from the ink and heat (e.g. SiC and $Si_3N_4$), and passivation with mechanical strength (e.g. Ta).

The substrate shown in FIG. 1 is cut from a large wafer crystal. While it is shown after cutting with the resistors exposed, in practice the further steps required to complete the printhead, as described below, will be carried out at the wafer level, and the individual printheads will be cut from the wafer after the printheads are substantially complete.

Figure 3:
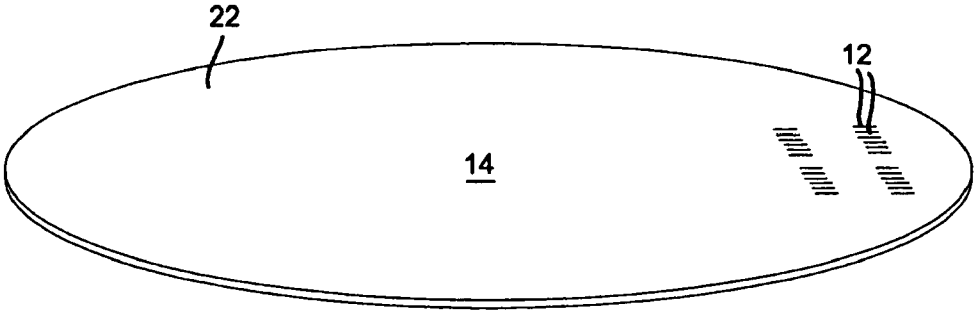
FIG. 3 is a perspective view of a complete wafer used in the simultaneous manufacture of a large number of printheads according to a preferred embodiment of the invention.

Thus, FIG. 3 shows a large circular wafer crystal 22, in which a small number of the ink supply slots 12 (not to scale) are shown. In reality, the surface of the wafer will be covered with arrays of ink supply slots and the thin film circuitry described above. The ink supply slots 12 are created in the wafer using laser ablation, sand blasting or other wafer cutting techniques. The slots can be cut either before (preferably) or after the thin film circuitry is laid down.

Figure 4:
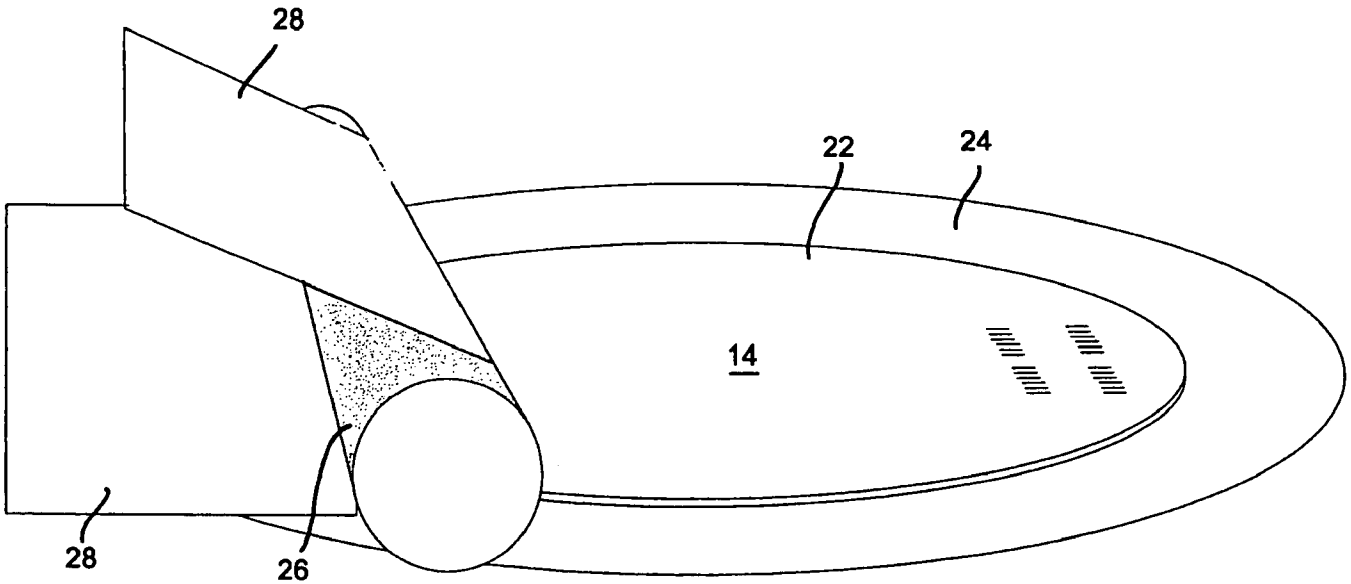
FIG. 4 is a perspective view similar to that of FIG. 3, showing a conformal tape being applied to the wafer.

In the next process step according to a preferred embodiment of the invention, FIG. 4, the wafer 22 is placed on a heated chuck 24 with the front surface 14 upwards. A pressure roller 26 then applies a conformal sheet material 28 across the wafer, covering the front surface. The conformal sheet material 28 may be a polydimethylsiloxane (PDMS) tape which is a semi-rigid tape which conforms well to the contours of the front surface 14 of the wafer, including the overlying resistors 16 and conductive traces 18, and mildly adheres to the surface when heated.

Figure 5A:
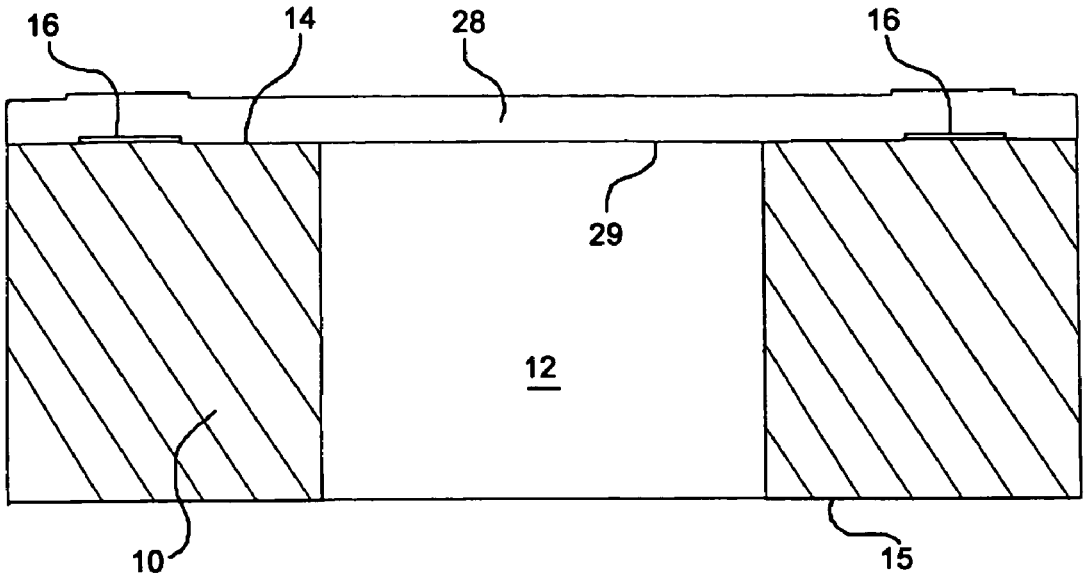
FIGS. 5A–5G are sectional elevation views similar to that of FIG. 2, showing the same section of substrate as it undergoes further processing steps according to a preferred embodiment of the invention.

FIG. 5A shows the portion of substrate shown in FIG. 2 after the conformal tape 28 has been applied to the wafer. For simplicity, in FIG. 5A and the subsequent figures of the drawings the conductive traces 18 have been omitted. It can be seen that the tape 28 conforms generally to the front surface 14 of the wafer and stretches across the mouth of the ink supply slot 12, the tape boundary surface 29 thereby recreating the original surface of the substrate before the slot 12 was created.

Figure 5B:
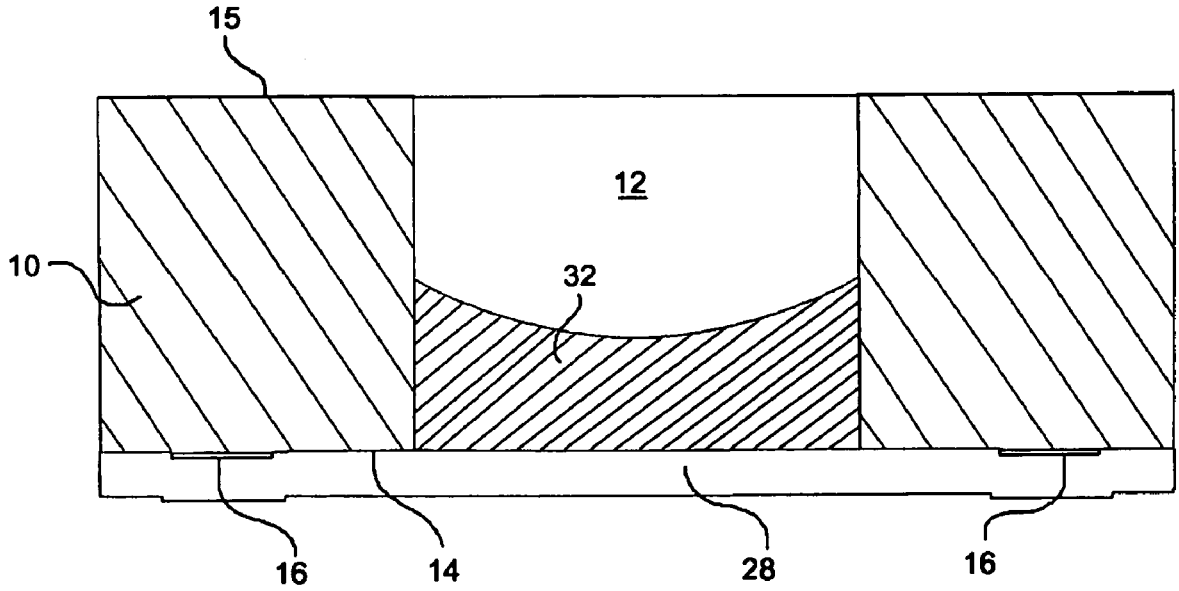

Next, FIG. 5B, the wafer is inverted such that the rear surface 15 is uppermost. Each of the ink supply slots 12 is then partially filled with a flowable resist material 32 which flows against the conformal tape 28. The resist material 32 is preferably a negative SU-8 photoresist available from MicroChem Corp., Newton, Mass. The photoresist 32 can be dispensed using a tool such as the Asymtek Liquid Dispenser Millennium Series M-2010, or any other tool suitable to fill a liquid into a small orifice. After the photoresist 32 is dispensed into the slots 12 it is soft baked. As is well-known, soft baking hardens the photoresist yet preserves its ability to be selectively exposed and developed as hereinafter described.

Figure 5C:
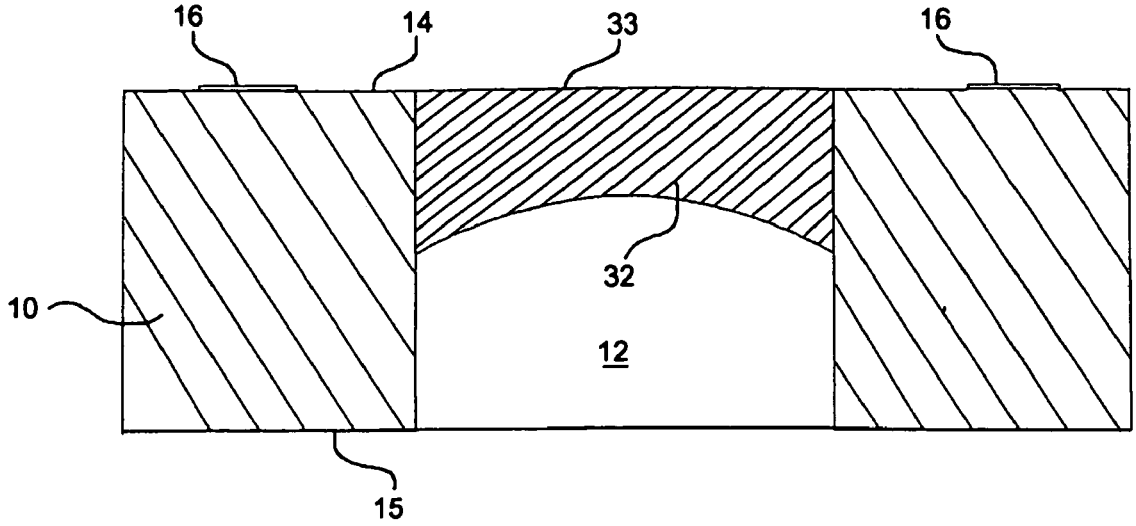

When the photoresist has solidified, the conformal tape is removed and the wafer is re-inverted, FIG. 5C, leaving a surface 33 of the photoresist 32 which is substantially flush with the front surface 14 of the substrate 10.

Figure 5D:
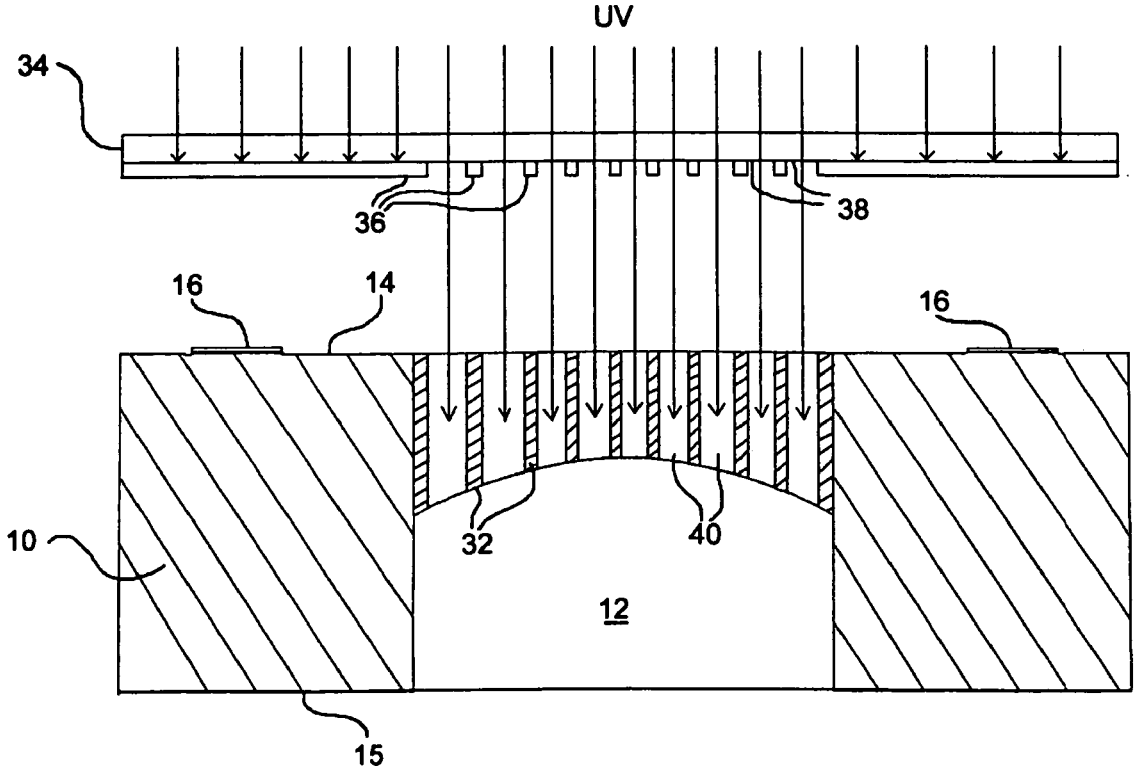

Next, FIG. 5D, the soft-baked photoresist 32 is selectively exposed to UV radiation through a mask 34 having regions 36 opaque to UV light, and complementary regions 38 transparent to UV light, so as to expose the photoresist 32 in a matrix of discrete regions 40 extending through the full depth of the photoresist 32. In FIG. 5D the exposed regions 40 are shown non-hatched to indicate simply that they have been exposed at this stage, not that they have been removed (developed). The selective exposure of the photoresist 32 may be carried out in an Ultratech UV Stepper Mask Aligner and Expose system (or other I-line UV Exposure Tool).

Figure 5E:
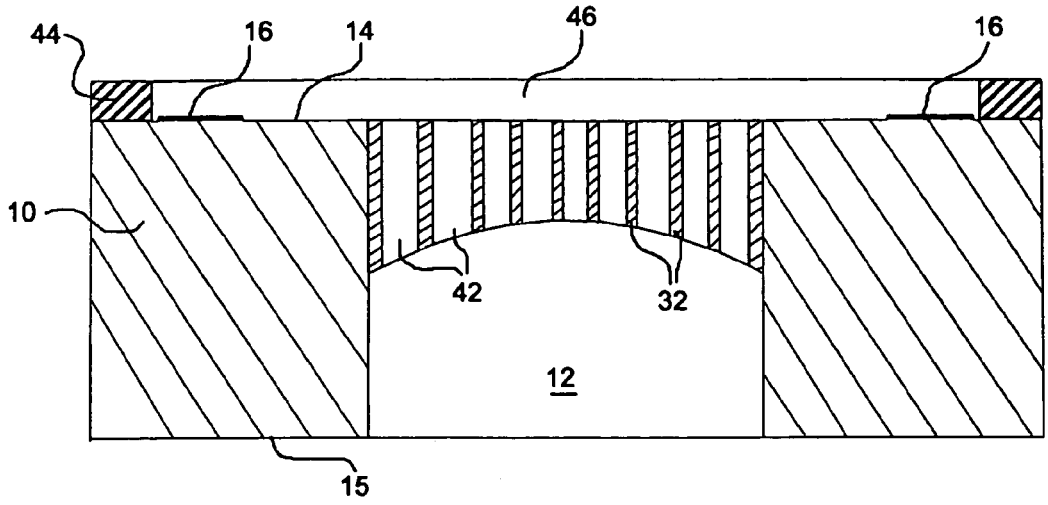

Now, FIG. 5E, the selectively exposed photoresist 32 is chemically developed, using conventional development steps, to preferentially dissolve away the exposed photoresist 40 to create a matrix of ink feed holes 42 extending fully through the depth of the photoresist layer 32. Following the formation of the holes 42, the photoresist 32 is hard baked to set it in its final form. Next, a conformal dry photoresist tape 44 is applied in conventional manner to the entire top surface 14 of the wafer 22, covering the photoresist 32 and resistors 16, and then the photoresist 44 is selectively exposed and developed to remove portions thereof in regions 46 to expose the ink slot 12 and resistors 16. The remaining photoresist 44 is then hard baked. The conformal photoresist tape 44 may be Dupont's Vacrel™ or other dry-film photoresist system.

Figure 5F:
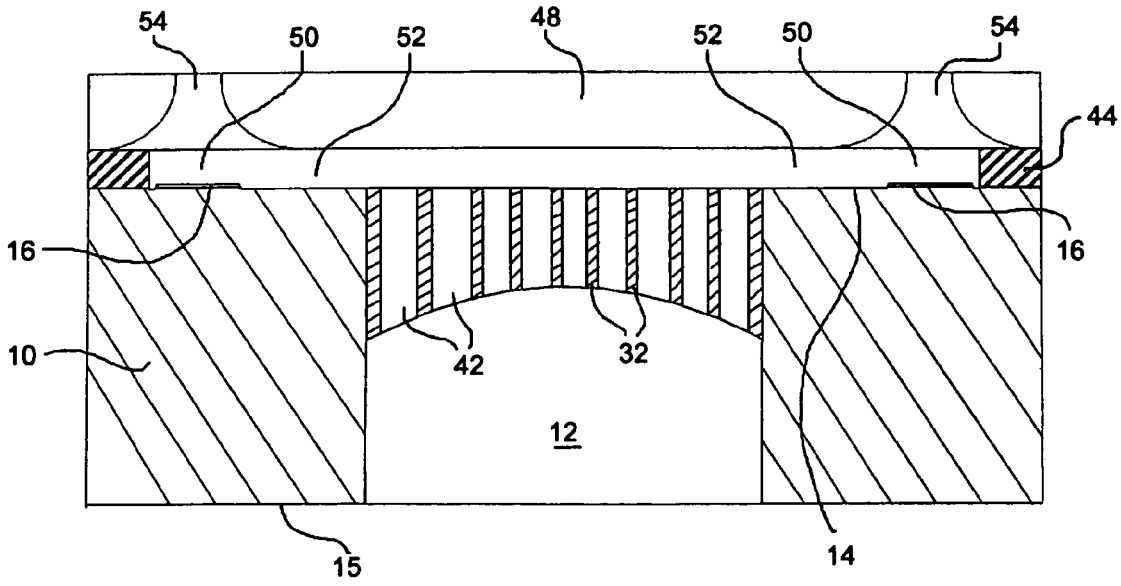

Finally, FIG. 5F, a pre-formed metallic nozzle plate 48 is applied to the top surface of the photoresist tape 44 in conventional manner. The final structure, as seen in FIG. 5F, comprises a plurality of ink ejection chambers 50 each containing a respective resistor 16, an ink supply path 52 from the ink supply slot 12 to the resistors 16, and a plurality of ink ejection orifices 54 each leading from a respective ink ejection chamber 50 to the exposed outer surface of the nozzle plate 48.

It will be understood that the manufacture of the structure above the substrate surface 14, i.e. the structure containing the ink ejection chambers 50, the ink supply paths 52 and the ink ejection orifices 54 as described above, is entirely conventional and well know to those skilled in the art. However, other ways of making the structure are possible.

For example, instead of using a dry photoresist tape 44 one could use a liquid photoresist such as SU-8. In that case, although the regions 40 would be exposed as shown in FIG. 5D, they would not be developed at that stage. Instead the wafer would be coated with SU-8 and soft baked. The regions 46 would then be exposed and the exposed regions 40 and 46 developed in a single step.

Figure 5G:
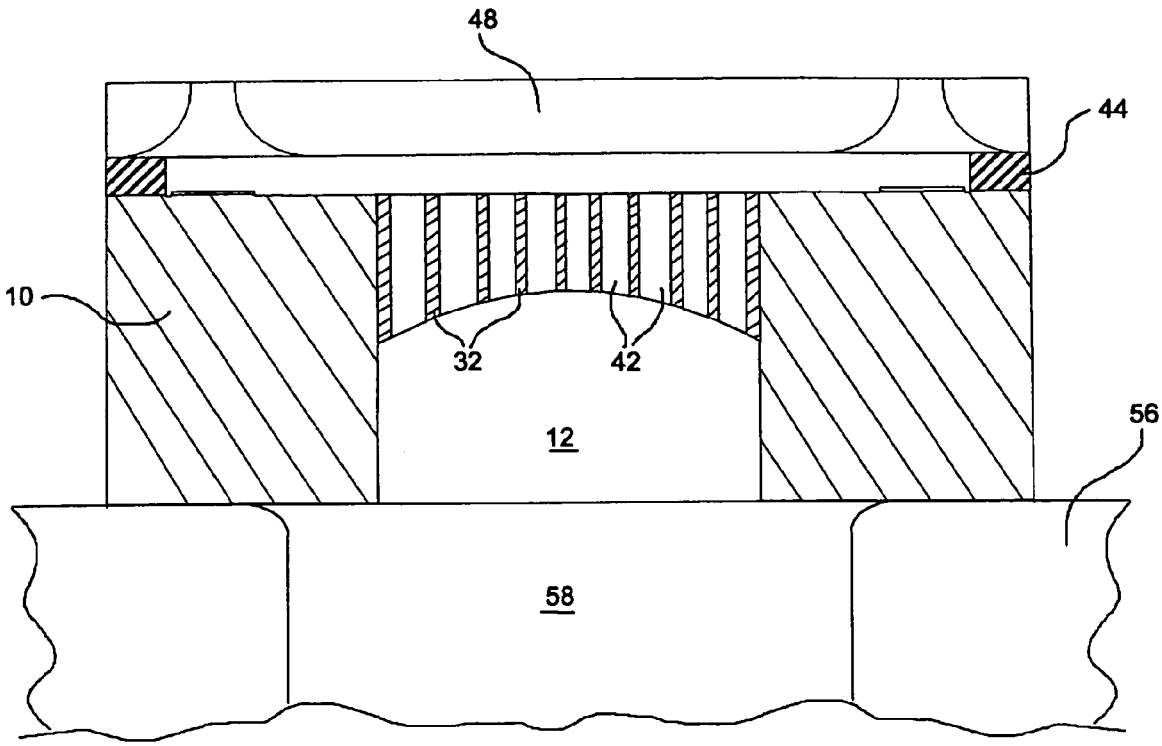

In use, FIG. 5G, the printhead is mounted on a print cartridge body 56 having an aperture 58 for supplying ink from at least one ink reservoir (not shown) to the printhead. To this end the printhead is mounted on the cartridge body 56 with the aperture 58 in fluid communication with the ink supply slot 12 in the printhead.

Figure 6:
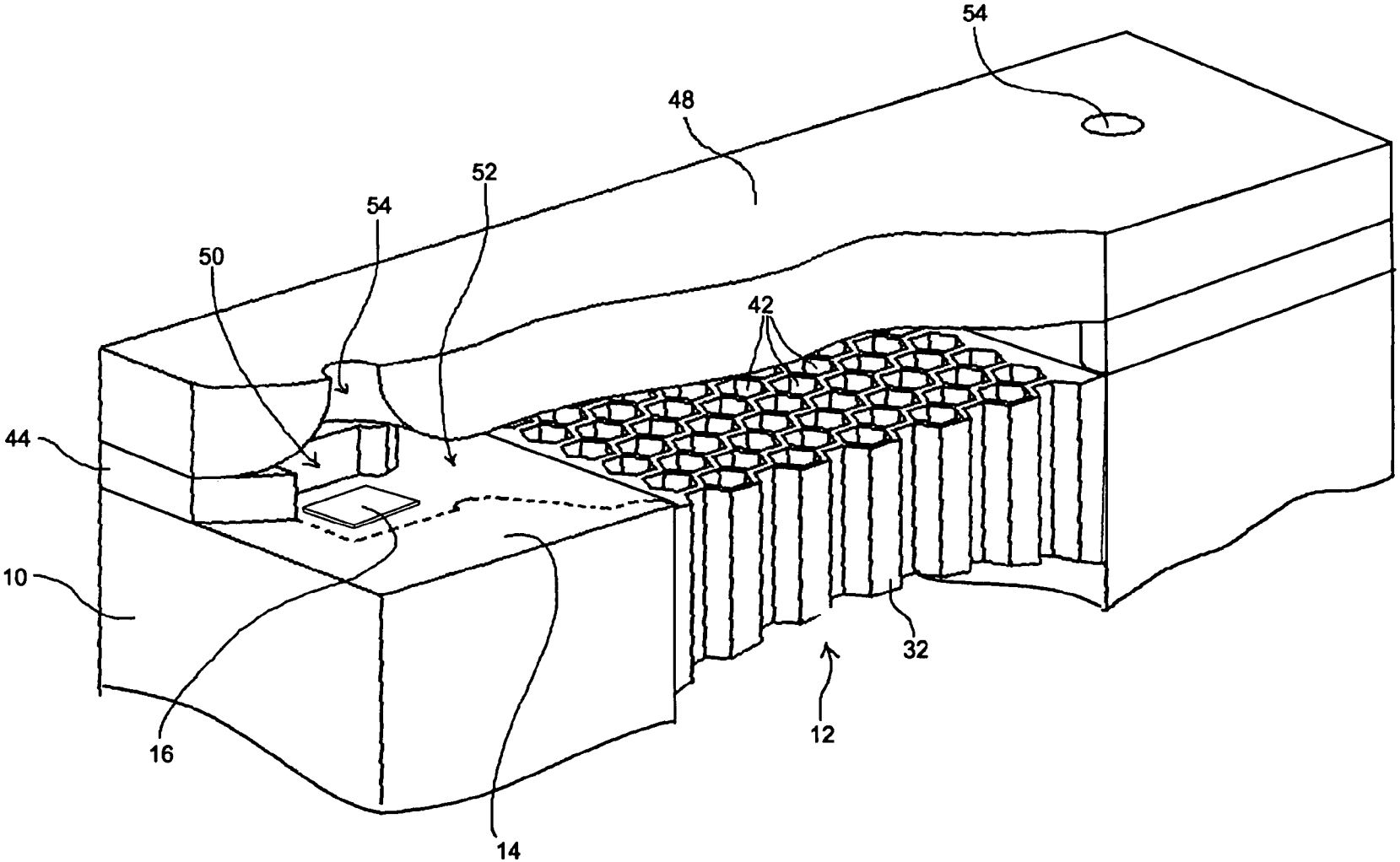
FIG. 6 is a cutaway perspective view of the printhead made by the method of FIGS. 5A–5G.

As seen in FIG. 6, the ink feed holes 42 form a filter which prevents overlarge ink particles and other solid contaminants from reaching the ink ejection chambers 50. The rate of ink flow is a function of the thickness (depth) of the photoresist 32 in the slot 12, the cross-sectional area of the holes 42, and the number of holes 42 per unit area. These parameters can be adjusted as necessary to provide desired ink flow characteristics. Preferably the cross-section of the holes 42 is hexagonal, since that provides a high packing density, but other polygonal cross-section holes 42 can be used, or even circular holes if desired.

As shown, the ink feed holes 42 have a constant cross-section throughout their length, this being produced by using collimated UV in the step shown in FIG. 5D. However, by using divergent or convergent UV one can produce tapered holes 42, i.e. holes whose cross-sectional area increases or decreases in the direction away from the ink supply paths 52 (i.e downwardly as seen in FIG. 5F). It is a particular advantage if the cross-sectional area of the ink feed holes 42 increases away from the ink supply paths 52 since this encourages trapped bubbles to migrate to the standpipe in the print cartridge body 56 rather than to the printhead.

The invention is not limited to the embodiment described herein and may be modified or varied without departing from the scope of the invention.

What is claimed:

1. An inkjet printhead comprising a substrate having at least one ink supply slot extending through a thickness thereof and providing fluid communication between an ink supply and a plurality of ink ejection elements, wherein the ink supply slot is filled to at least part of its depth with a selectively exposed and developed resist material having a plurality of ink feed holes therethrough forming a filter.

2. An inkjet printhead as claimed in claim 1, wherein the ink feed holes have a substantially regular polygonal cross-section.

3. An inkjet printhead as claimed in claim 2, wherein the ink feed holes have a hexagonal cross-section.

4. An inkjet printhead as claimed in claim 1, wherein the ink ejection elements are arrayed on one surface of the substrate and the resist material is substantially flush with the said one surface.

5. An inkjet printhead as claimed in claim 1, wherein the resist material only partially fills the depth of the ink supply slot.

6. An inkjet printhead as claimed in claim 1, wherein the ink feed holes are tapered.

7. An inkjet printhead as claimed in claim 6, wherein a cross-sectional area of the ink feed holes increases away from the ink ejection elements.

8. An inkjet printhead as claimed in claim 1, wherein the plurality of ink ejection elements are arrayed on one surface of the substrate alongside the ink supply slot, and wherein the printhead further includes a structure covering the said one surface of the substrate and the ink ejection elements, the structure defining a plurality of ink ejection chambers associated respectively with the ink ejection elements, an ink supply path from the ink supply slot to the ink ejection elements, and a plurality of ink ejection orifices each leading from a respective ink ejection chamber to an exposed outer surface of the structure.

9. A print cartridge comprising a cartridge body having at least one aperture for supplying ink from at least one ink reservoir to a printhead, and a printhead as claimed in claim 1 mounted on the cartridge body with said at least one aperture in fluid communication with said at least one ink supply slot in the printhead.

10. A method of making an inkjet printhead comprising providing a substrate having at least one ink supply slot extending through the thickness thereof to provide fluid communication between an ink supply and a plurality of ink ejection elements, filling an ink supply slot to at least part of its depth with a resist material, and selectively exposing and developing the resist material to provide a plurality of ink feed holes therethrough forming a filter.

11. A method as claimed in claim 10, wherein the step of filling the ink supply slot to at least part of its depth with a resist material comprises applying a conformal sheet material to one surface of the substrate, at least partially filling the ink supply slot from the opposite surface of the substrate with a flowable resist material, treating the resist material to harden it without destroying its ability to be selectively exposed and developed, and removing the conformal sheet material.

12. A method as claimed in claim 11, wherein the ink ejection elements are arrayed on one surface of the substrate and the method further includes forming a plurality of ink ejection chambers associated respectively with the ink ejection elements, the ink ejection chambers being formed at least in part by providing a resist layer on the said one surface and selectively exposing and developing the resist layer.

13. A method as claimed in claim 12, wherein the resist layer is applied as a liquid.

14. A method as claimed in claim 12, wherein the resist layer is applied as a dry sheet material.

* * * * *